US005554952A

United States Patent [19]

Stacey

[11] Patent Number: 5,554,952

[45] Date of Patent: Sep. 10, 1996

[54] FAST RESPONDING METHOD AND APPARATUS FOR THREE PHASE A/C VOLTAGE SENSING

[75] Inventor: Eric J. Stacey, Pittsburgh, Pa.

[73] Assignee: Sundstrand Corporation, Rockford, Ill.

[21] Appl. No.: 196,353

[22] Filed: Feb. 15, 1994

[51] Int. Cl.[6] ..... G06G 7/64

[52] U.S. Cl. ..... 327/339; 327/361; 327/142; 363/95

[58] Field of Search ..... 327/142, 146, 327/233, 236, 240, 243, 339, 341, 345, 361, 407, 355, 336; 332/109; 326/104; 363/21, 41, 78, 95; 323/222, 282

[56] References Cited

U.S. PATENT DOCUMENTS

| | | | |
|---|---|---|---|
| 3,624,524 | 11/1971 | Bryden | 327/361 |
| 3,913,022 | 10/1975 | Kinoshita et al. | 327/336 |
| 4,245,183 | 1/1981 | Glennon | 327/336 |
| 4,393,413 | 7/1983 | Kaneko | 358/326 |
| 4,757,214 | 7/1988 | Kobayashi | 326/104 |
| 5,301,098 | 4/1994 | Dhyanchand et al. | 363/41 |
| 5,327,335 | 7/1994 | Maddali et al. | 363/95 |
| 5,430,406 | 7/1995 | Kolodziejczyk | 327/339 |
| 5,452,198 | 9/1995 | Jessee | 363/78 |
| 5,504,521 | 4/1996 | Webb et al. | 348/180 |

*Primary Examiner*—Timothy P. Callahan
*Assistant Examiner*—Jung Ho Kim
*Attorney, Agent, or Firm*—Jeffery J. Makeever

[57] ABSTRACT

An apparatus for generating a sensing signal from a generally periodic multi-phase AC signal is set forth. The apparatus utilizes a plurality of integrator circuits, a single integrator circuit being respectively associated with each phase of the AC signal. The integrator circuits each generate an integrated signal from the respective phase of the AC signal by integrating the respective phase during a time period between sloping transitions of the respective phase. A reset circuit is respectively associated with each integrator circuit for resetting each integrator circuit at the sloping transitions of the respective phase. The integrated outputs are summed by a summing circuit to form the sensing signal.

24 Claims, 6 Drawing Sheets

FAST RESPONDING METHOD AND APPARATUS FOR THREE PHASE A/C VOLTAGE SENSING

FIELD OF THE INVENTION

The present invention relates to the AC voltage sensing of a three phase AC power source. More specifically, the present invention is directed to an apparatus and method for AC voltage sensing of a three phase power source to generate a sensing signal for voltage control of a pulse width modulated inverter.

BACKGROUND OF THE INVENTION

Pulse width modulated inverters used in three phase AC power supplies are usually equipped with harmonic filters so that the output voltages are acceptable to the applied loads. Harmonic content is ordinarily less than 5%. The result is a three phase sinusoidal voltage waveform output with small ripple voltages superimposed.

When various loads are applied, phase shifts in the ripple components occur such that the peak amplitude of the output voltages change as a function of applied load even though the fundamental component remains constant. This characteristic presents a problem in sensing the true average RMS value in a form usable for voltage control.

In a typical voltage-regulated inverter, the inverter output voltage is fed back to an error amplifier through a sensing signal processor which generates a sensing signal. Ideally, the sensing signal is proportional to the average or RMS amplitude of the three phase output voltages. The sensing signal is used in conjunction with a reference signal to generate a further signal which is used to control the output voltage of the inverter. Transient or ripple errors in the sensing signal cause distortion to be transmitted through the system and ultimately effects regulation of the inverter output.

Several different methods are commonly used to generate the sensing signal. In one method, each of the AC voltage outputs of the inverter is rectified and filtered to produce the sensing signal. Sensing signals generated in this manner tend to be peak sensitive and, therefore, are sensitive to changes in the characteristics of the applied load.

In a further method, the AC voltage outputs of the inverter are applied to a multiplying circuit, the output of which is subsequently filtered to generate a sensing signal which represents the RMS value of the AC output voltages. While this method produces a good steady state signal, the filtering of the signal causes a delay which prevents timely response of the sensing signal to transient changes in the sensed voltage which are produced, for example, by load switching. The delay in sensing the true AC output value is transferred as an error to the voltage control circuits and thus adversely effects the inverter output transient response characteristics.

A further method of voltage sensing is described in U.S. Pat. No. 5,452,198 entitled APPARATUS AND METHOD FOR A-C VOLTAGE SENSING filed in the name of Ralph D. Jessee. That patent describes an AC sensing circuit wherein a first integrated signal is generated by integrating a single phase AC signal during a time period between negative transitions of the AC signal. The integrated signal is reset at negative transitions of the AC signal. A second integrated signal is generated by integrating the AC signal during the time period between positive transitions of the AC signal. The second integrated signal is reset at positive transitions of the AC signal. The sensing signal is generated by taking the difference in magnitude between the first and second integrated output signals.

SUMMARY OF THE INVENTION

An apparatus for generating a sensing signal from a generally periodic multi-phase AC signal is set forth. The apparatus utilizes a plurality of integrator circuits, a single integrator circuit being respectively associated with each phase of the AC signal. The integrator circuits each generate an integrated signal from the respective phase of the AC signal by integrating the respective phase during a time period between sloping transitions of the respective phase. A reset circuit is respectively associated with each integrator circuit for resetting each integrator circuit at the sloping transitions of the respective phase. The integrated outputs are summed by a summing circuit to form the sensing signal.

In one embodiment of the invention, the reset circuits each include a comparator and a one-shot circuit. The comparator is configured as a level detector and has an input connected to receive the respective phase of the AC signal and further has an output indicative of the sloping transition. The output of the comparator is supplied to the one shot circuit. The one shot circuit generates the reset signal to the respective integrator in response to the output signal of the comparator.

In another embodiment, the level detector and one-shot circuit functions are implemented using a single comparator. The comparator is configured as a Schmitt trigger and has its output signal supplied through a capacitor to drive an FET that is connected across the integrating capacitor of the integrator circuit.

In another embodiment of the invention, the reset circuit includes a ROM having digital storage bits that are addressable to generate digital signal outputs. The digital signal outputs represent levels of a reference waveform for use in generating the multi-phase AC signal. The reset circuit further includes means responsive to one or more of the digital signal outputs for generating the reset signal upon the occurrence of a selected pattern of one or more digital signal outputs. The selected pattern is preferably indicative of the occurrence of a sloping transition, but may indicate any fixed periodic occurrence associated with the waveform.

In one advantageous embodiment, the apparatus further includes a common mode rejection circuit for removing the common mode components of the multi-phase AC signal so that the common mode components do not form a part of the sensing signal output.

A method for generation of the sensing signal is also disclosed.

BRIEF DESCRIPTION OF THE DRAWINGS

Other objects and features of the present invention may be further understood by reference to the following detailed description of the preferred embodiments of the invention taken in conjunction with the accompanying drawings, on which.

It will be understood that the drawings are not necessarily to scale. In certain instances, details which are not necessary for understanding various aspects of the present invention have been omitted for clarity.

DESCRIPTION OF THE PREFERRED EMBODIMENTS

Figure 1:
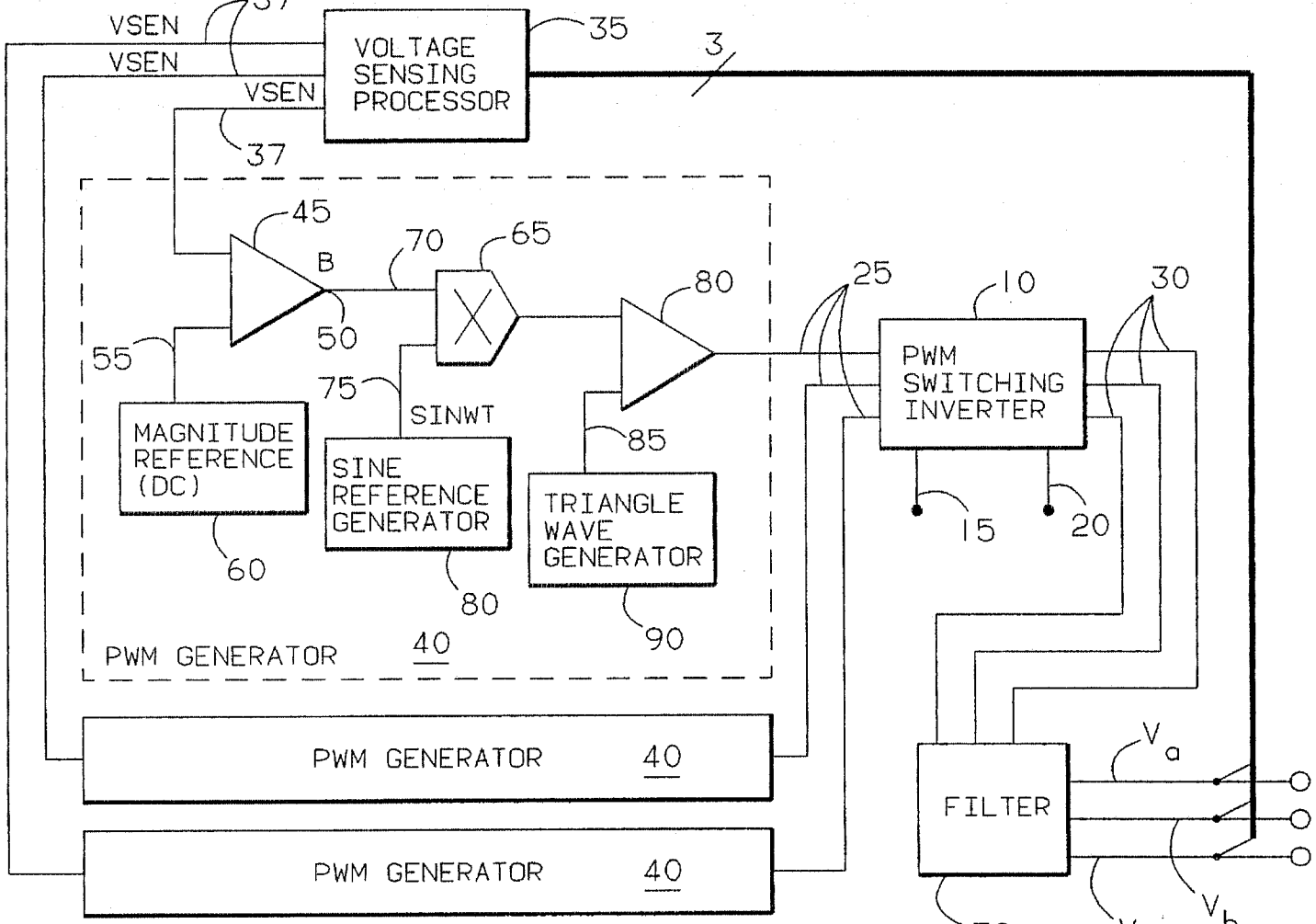
FIG. 1 is a schematic block diagram of an inverter system which may employ a sensing processor constructed in accordance with the present invention.

FIG. 1 is a schematic diagram of a voltage regulated pulse width modulated AC inverter system. The system includes a pulse width modulated (PWM) inverter circuit 10 having DC inputs 15 and 20, pulse inputs 25 for receiving pulse width modulated signals, and output lines 30 for respectively carrying each the pulse width modulated phases of a three phase AC voltage. The lines 30 are supplied to the input of a filter 32 which effectively converts the pulses on lines 30 to smooth sinusoidal waveforms. In the disclosed embodiment, the sinusoidal waveforms are in the form of a generally periodic, three phase AC voltage having phases Va, Vb, and Vc. The pulse signals supplied to the inputs 25 control operation of the inverter circuit 10 to regulate the AC voltage phases Va, Vb, Vc.

The AC voltage outputs Va, Vb, and Vc are fed back to the inputs of a voltage sensing processor 35, the details of which will be set forth below. The voltage sensing processor 35 generates a DC sensing signal $V_{sen}$ on each of lines 37. The DC sensing signal $V_{sen}$ is representative of the average amplitudes of the AC phase signals Va, Vb, and Vc that are output from the inverter system.

A pulse width modulation (PWM) generator circuit 40 is associated with each phase Va, Vb, Vc of the AC voltage output. Each PWM generator circuit 40 includes an error amplifier 45 that generates an error signal B at its respective output 50 that represents the difference between the sensing signal $V_{sen}$ and the DC output 55 of a DC magnitude reference generator 60. Although FIG. 1 implies that the PWM generator circuits 40 are each designed from a separate set of the same component types, those of ordinary skill in the art will recognize that the PWM generator circuits can be optimized by sharing of the same components between two or more generators. Thus, for example, all three PWM generators 40, under certain design conditions, share a common error amplifier 45 and DC magnitude reference 60.

A modulator circuit 65 in each of the generator circuits 40 has a first input 70 accepting the error signal B and a second input 75 accepting a sine wave output signal Sin ωt from a sine reference generator 80. The output of the modulator 60 has a magnitude of B Sin ωt.

A comparator circuit 80 is used in each of the generator circuits 40 and has a first input connected to accept the output of the modulator 65 and a second input 85 connected to accept a triangle wave signal output from a triangle wave generator 90. The output of the comparator circuit 80 is supplied to the pulse inputs 25 of the PWM inverter circuit 10 to control the generation of the three phase AC signal output on lines 30. In a representative embodiment of the inverter circuit 10, the inverter circuit includes a plurality of switching devices which are selectively controlled by the pulse inputs 25.

Figure 2:
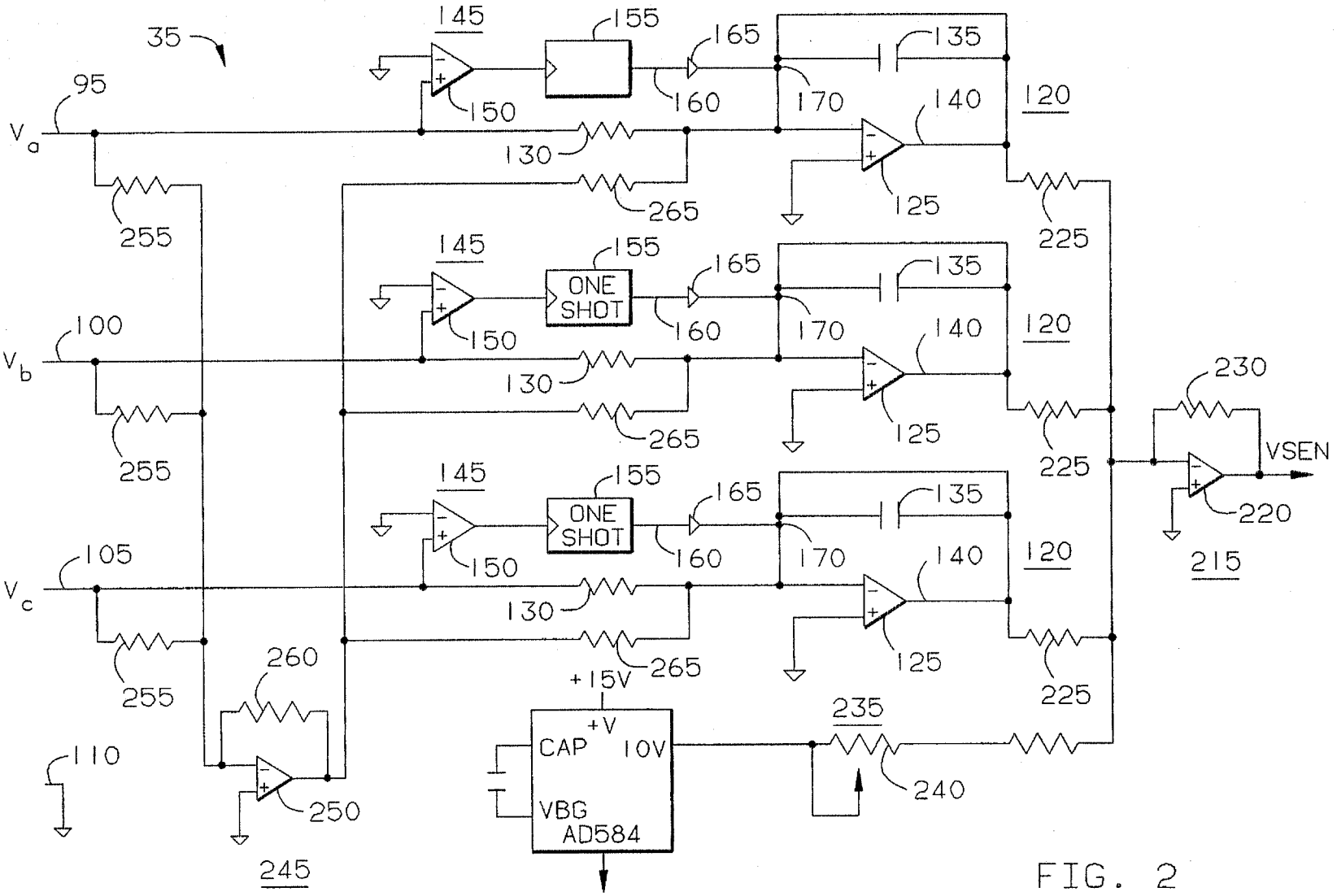
FIG. 2 is a schematic diagram of one embodiment of a sensing processor circuit constructed in accordance with the present invention.

FIG. 2 is a schematic diagram of the voltage sensing processor 35 of FIG. 1. As illustrated, the processor 35 has three input lines 95, 100, 105 for respectively receiving phases Va, Vb, and Vc of the three phase AC voltage output from the filter 32. A neutral input can also be provided as shown at line 110. It will be recognized by those skilled in the art that the magnitude of the phases Va, Vb, and Vc may be scaled at the input of the sensing processor 35 to a voltage level which can be managed by the components of the processor. For example, phases Va, Vb, and Vc may be scaled to range between +15V and −15V.

The sensing processor circuit 35 includes three integrator circuits shown generally at 120. Each integrator circuit is respectively connected to and associated with a single phase of the three phase AC voltage output signal and includes an op-amp 125 having its negative input connected to the respective phase Va, Vb, Vc of the AC voltage output signal through respective resistors 130, and a capacitor 135 connected between the output of each op amp 125 and the negative input. The positive input of each op amp 125 is connected to neutral or ground. An integrated output signal is present at the output of each of the op amps on lines 140.

A reset circuit, shown generally at 145, is respectively associated with each of the integrator circuits 120. Each reset circuit includes an op amp 150 connected as a level detection circuit. Each op amp has a positive input connected to receive the respective phase Va, Vb, Vc of the three phase AC output signal and a negative input connected to a zero reference level. In the embodiment shown, the zero reference level is neutral or Ov.

The output of each level detection circuit is supplied directly the input of a respective one shot circuit 155. The one shot circuit 155 provides an output pulse on line 160 whenever the respective phase of the three phase AC signal Va, Vb, Vc experiences a positive going transition with respect to the zero reference level. Although the illustrated circuit provides an output signal on line 160 whenever there is a positive going transition of the respective phase, those skilled in the art will recognize that the circuits can be designed to generate an output pulse in response to negative going transitions. Any such sloping transition and zero reference level of the respective phase can be utilized. The output pulse from the respective one shot circuit 155 is optionally supplied to a logic inverter 165 and is used to control a switch 170 which discharges the capacitor 135 of the respective integrator circuit 145 thereby resetting the respective integrator. Each phase Va, Vb, Vc of the three phase AC voltage signal is thus only integrated between sloping transitions of the respective phase.

Figure 3:
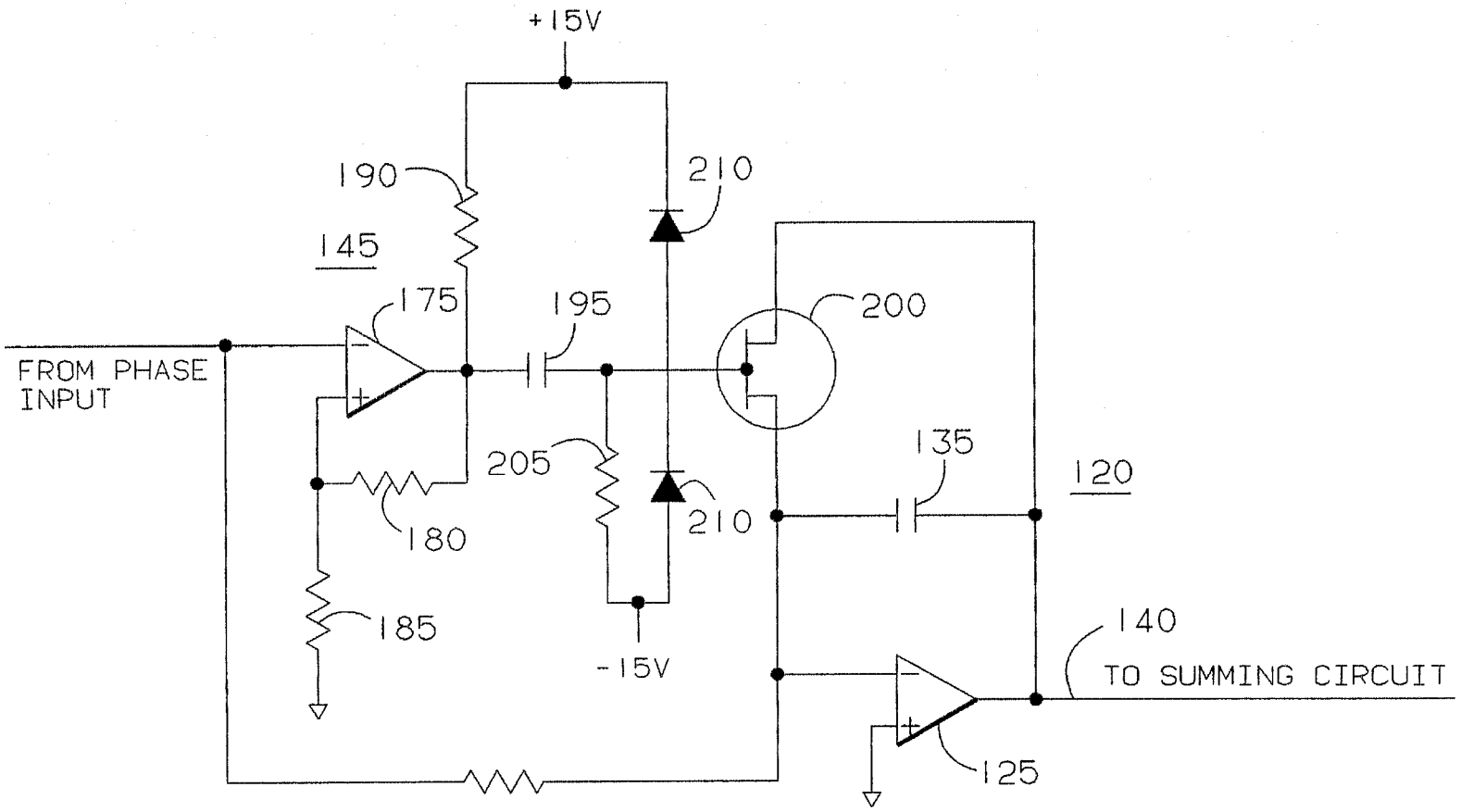
FIG. 3 is a schematic diagram of an embodiment of a reset and integrator circuit

A schematic diagram of an alternative construction of the reset circuit and integrating circuit associated with each phase Va, Vb, Vc of the three phase AC input signal is shown in FIG. 3. As illustrated, the reset circuit 145 includes a Schmitt trigger circuit based on op amp 175. Comparator 175 receives the respective phase input at the negative input thereof. Positive feedback is supplied from the output of the op amp 175 through the feedback resistor network 180 and 185. A pull-up resistor 190 connects the output of the op amp 175 to the positive power supply, shown here as being +15

VDC. A capacitor 195 is connected between the output of op amp 175 and the gate of an FET switch 200. A pull-down resistor 205 is connected between the gate of the FET and the negative power supply, shown here as −15VDC. A pair of protective diodes 210 are also connected to the gate of the FET switch 200.

In operation, the Schmitt trigger generates a pulse to the gate of the FET switch 200 through capacitor 195 when the respective phase undergoes a positive transition across the zero reference level. The pulse to the FET switch 200 causes the FET to conduct thereby discharging capacitor 135 and effectively resetting the integrator circuit 120 back to an initial condition.

Referring again to FIG. 2, the integrated output signals from the integrator circuits 120 are supplied to a summing circuit, shown generally at 215. The summing circuit 215 includes an op amp 220 having its positive input connected to neutral or ground. The negative input of the op amp 220 is connected to receive each of the integrated output signals through a respective resistor 225. A feedback resistor 230 is connected between the output of the op amp 220 and the negative input thereof. The output of the op amp 220 may be used directly as the sensing signal Vsen and may be supplied directly to the PWM generator circuits 40. Alternatively, the output of the op amp may be further processed before it is supplied for use by the PWM generator circuits 40 but may result in a delayed response to changes in the phase Va, Vb, Vc.

Optionally, a current source circuit 235 may be provided to balance any offset currents at the outputs of the integrators to the summing circuit. In the embodiment shown, and AD584 is used for this purpose. Adjustment of the output current is made by adjustment of variable resistor 240.

The sensing processor circuit 35 may also include a common mode rejection circuit, shown generally at 245, for removing common mode components of the three phase AC signal. The common mode rejection circuit 245 includes an op amp 250 having its positive input connected to neutral. The negative input of the op amp 250 is connected to receive each of the three phases Va, Vb, Vc of the three phase AC voltage signal through a respective resistor 225. A feedback resistor 260 is connected between the output of op amp 250 and the negative input thereof. The output of the op amp 250 is connected to the negative inputs of the op amps 125 of the integrator circuits 120 through respective resistors 265. As a result, the common mode components of the three phase AC voltage signal do not form a part of the sensing signal output Vsen.

Figure 4:
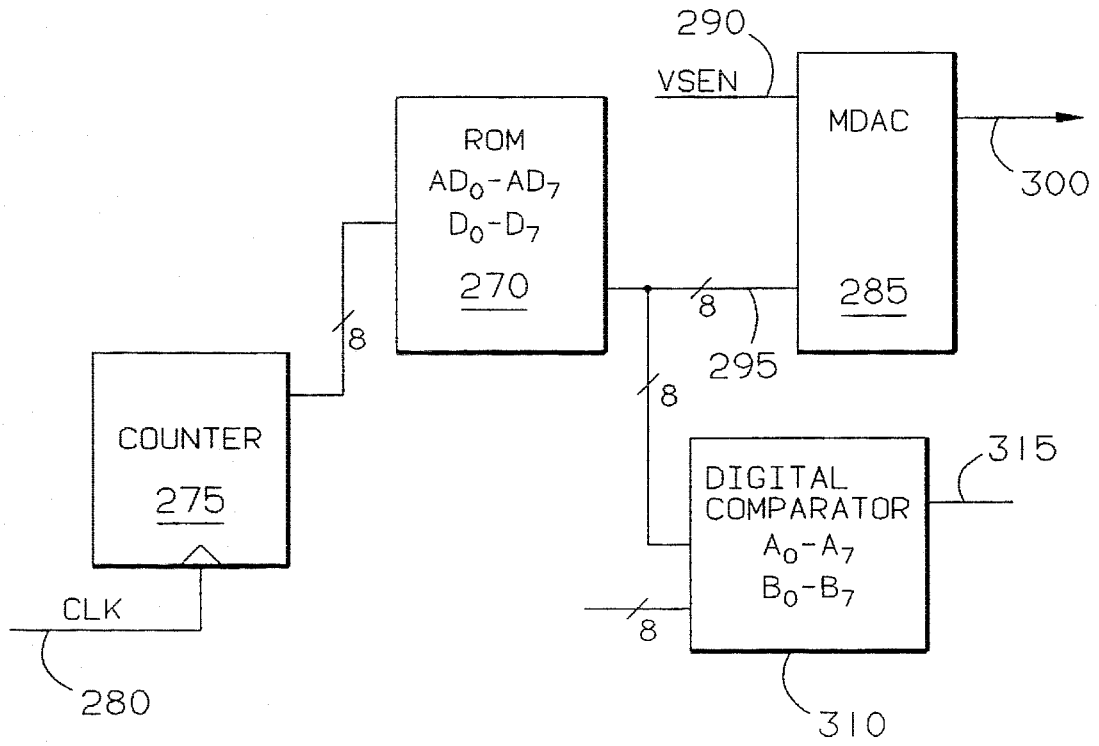
FIG. 4 is a schematic diagram of one embodiment of a reset circuit.

FIG. 4 shows an alternative circuit for resetting the integrator circuits 120. In many inverter systems, a ROM 270 containing stored bits representing levels of a reference waveform, for example, a sine wave, is used in conjunction with other components to generate the reference wave form which is to be compared to the triangle waveform. The stored bits are addressed by a counter 275 that receives a clock signal at line 280. The output of the ROM 270 is in the form of digital signals corresponding to the stored bit pattern of the respective address. The digital signals are supplied to the input of a multiplying digital-to-analog converter 285 which also receives the sensing signal $V_{sen}$ at line 290 for multiplication with the digital inputs on lines 295 binary valve represented by the output of the digital to analog converter at line 300 is applied, for example, to the input of comparator 80 shown in FIG. 1 to be compared with the triangle wave output from the triangle wave generator 90.

In the alternative design of the reset circuit, a reset signal is supplied to the respective integrator circuit 120 upon the occurrence of a predetermined binary pattern of one or more digital outputs from the ROM 270. In the circuit illustrated herein, a digital comparator 310 is connected to receive the binary bits output from ROM 270 at the input lines A0–A7. The comparator 310 is also connected to receive a predetermined pattern of binary bits at inputs B0–B7. The predetermined pattern of bits at B0–B7 may be hard-wired or, for example, may be received from a latch or the like under control of a microprocessor. When the bit pattern at A0–A7 is identical to the bit pattern at BO–B7, the comparator generates a signal at line 315 indicative of the coincidence of the bit patterns. The output at line 315 may be used as the reset signal to reset the respective integrating circuit or, alternatively, a buffer circuit, such as a one shot circuit may be interposed between the comparator output 315 and the reset signal supplied to the integrator circuit.

Figures 5A, 5B, 5C, 5D, 5E:
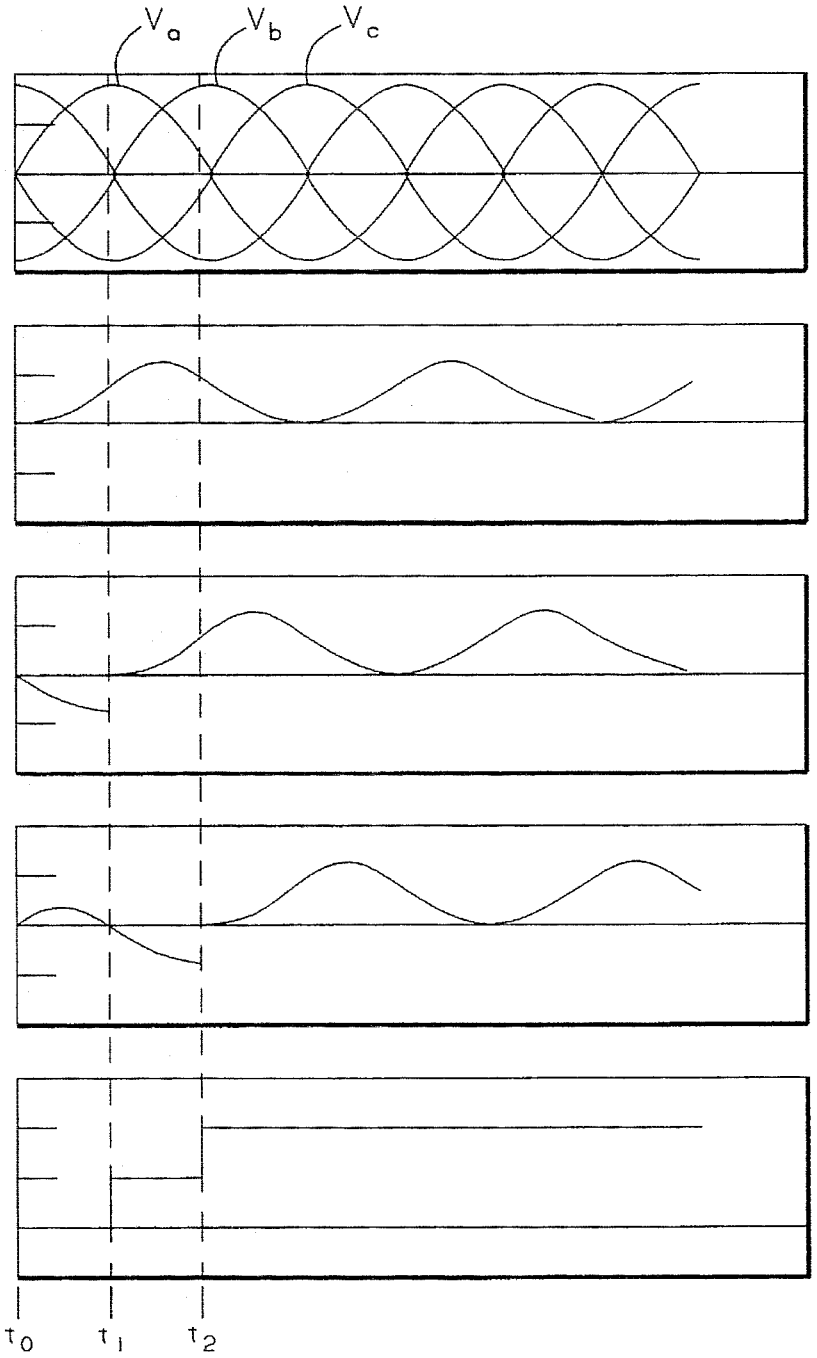
FIGS. 5A–5E are graphical representations of a three phase, sinusoidal AC signal input to the embodiment of the invention shown in FIG. 2 and the resulting output signals from the integrators and the summing circuit.

FIGS. 5B–5E illustrate the response of the circuit of FIG. 2 to the three phase sinusoidal AC input signal of FIG. 5A. At time $t_0$, phase Va undergoes a positive transition and the integrator circuit 120 associated with phase Va is reset. The output of integrator circuit associated with phase Va is illustrated in FIG. 5B. At time $t_1$, phase Vb undergoes a positive transition and the integrator circuit associated with phase Vb is reset. The output of integrator circuit associated with phase Vb is illustrated in FIG. 5C. At time $t_2$, phase Vc undergoes a positive transition and the integrator circuit associated with phase Vc is reset. The output of integrator circuit associated with phase Vc is illustrated in FIG. 5D. All three outputs from the integrating circuits are summed in the summing circuit 215, the output of which is illustrated in FIG. 5E. Since all three integrator circuits are reset within a single cycle period of the three phase AC input, a DC voltage representing the average value of all three phases Va, Vb, Vc of the three phase AC input is available at the output of the summing circuit 215 within a single cycle period. Use of the circuit shown in FIG. 2 in the system shown in FIG. 1 thus allows the PWM generator to respond to changes in the three phase AC voltage output within a single cycle period.

Figures 6A, 6B, 6C, 6D, 6E:
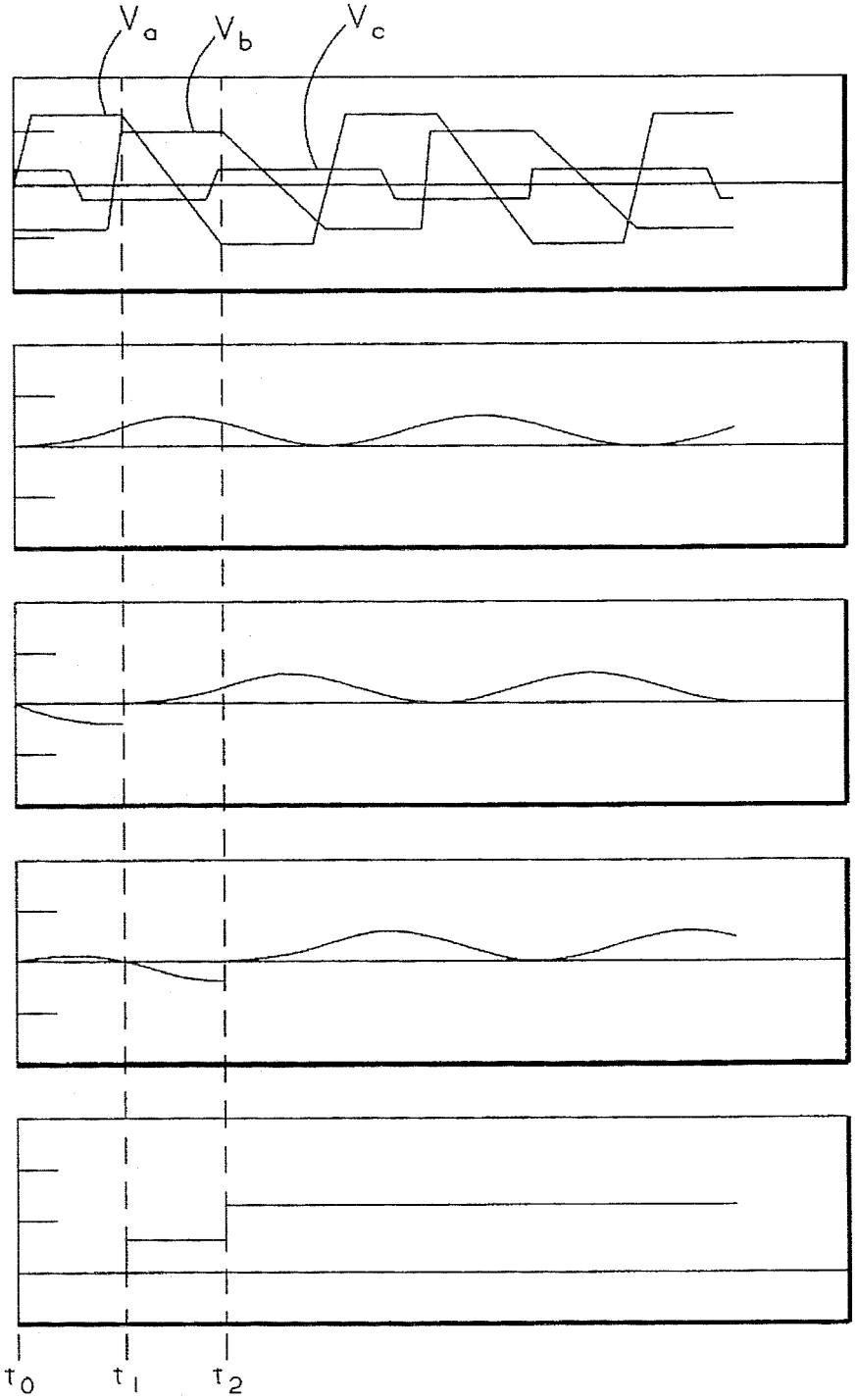
FIGS. 6A–6E are graphical representation of an unbalanced three phase non-sinusoidal AC signal input to the embodiment of the invention shown in FIG. 2 and the resulting output signals from the integrators and summing circuit.

FIGS. 6B–6E illustrate the response of the circuit of FIG. 2 to an unbalanced, generally periodic, three phase, non-sinusoidal AC input signal of FIG. 6A. As was the case with the response to the sinusoidal voltage input of FIG. 5A, the integrator circuit associated with phase Va is reset at time $t_0$ when phase Va undergoes a positive transition. The integrator circuit associated with phase Vb is reset at time $t_1$ when phase Vb undergoes a positive transition. The integrator circuit associated with phase Vc is reset at time $t_2$ when phase Vc undergoes a positive transition. All three outputs from the integrator circuits are summed in the summing circuit 215, to generate a DC voltage representing the average value of all three phases Va, Vb, Vc of the three phase AC input within a single cycle period. Use of the circuit shown in FIG. 2 in the system shown in FIG. 1 thus allows the PWM generator to respond to changes in the three phase AC voltage output within a single cycle period, even where the AC voltage that is sensed is unbalanced and non-sinusoidal.

The following table sets forth the general components and relative component values which may be employed in the embodiment shown in FIGS. 2 or 3:

| Component | Value or Relative Value |
|---|---|
| 125, 150, 175, 220, 250 | LF412 |
| 130, 225, 230, 255, 260 | R |

-continued

| Component | Value or Relative Value |
|---|---|
| 265 | 3R |
| 200 | 2N4857 |

All circuits in the embodiment described herein are powered from +15V and −15V supplies.

Although the foregoing embodiments of the sensing processor circuit have been described in the context of a PWM inverter system, the sensing processor circuit is subject to any number of applications. It is particularly suitable in any application in which an accurate sensing of a generally periodic multiphase AC input signal is required.

While several embodiments of the invention have been described hereinabove, those of ordinary skill in the art will recognize that the embodiments may be modified and altered without departing from the central spirit and scope of the invention. Thus, the preferred embodiments are to be considered in all respects as illustrative and not restrictive, the scope of the invention being indicated by the appended claims rather than by the foregoing description. It is therefore the intention of the inventor to embrace herein all changes and modifications which come within the meaning and range of equivalency of the claims.

What is claimed:

1. An apparatus for generating a sensing signal from a generally periodic multi-phase AC signal, each phase of said AC signal having sloping transitions, said apparatus comprising:

integrating means having a single integrator respectively associated with each phase of said AC signal for generating an integrated signal from the respective phase of said AC signal by integrating said respective phase during a time period between predetermined sloping transitions of said phase;

reset means respectively associated with each integrator for resetting each integrator at said predetermined sloping transitions of the respective phase; and means for summing said integrated signals generated by said integrating means to form said sensing signal.

2. An apparatus for generating a sensing signal from a generally periodic multi-phase AC signal, each phase of said ac signal having sloping transitions, said apparatus comprising:

integrating means having a single integrator respectively associated with each phase of said AC signal for generating an integrated signal from the respective phase of said AC signal by integrating said respective phase during a time period between predetermined sloping transitions of said phase;

reset means respectively associated with each integrator for resetting each integrator at said predetermined sloping transitions of the respective phase;

means for summing said integrated signals generated by said integrating means to form said sensing signal; and means for removing common mode components of said multi-phase AC signal.

3. An apparatus as claimed in claim 1 wherein said reset means comprises:

a comparator having an input connected to receive the respective phase of said AC signal and further generating an output signal indicative of said sloping transitions; and a one shot circuit for generating a reset signal to the respective integrator in response to said output signal of said comparator.

4. An apparatus as claimed in claim 1 wherein said reset means comprises:

at least one ROM having digital storage bits that are addressable to generate digital signal outputs, said digital signal outputs representing levels of a reference waveform for use in generating said multi-phase Ac signal; and means responsive to one or more of said digital signal outputs for generating a reset signal upon occurrence of a selected pattern of one or more digital signal outputs.

5. An apparatus for generating a sensing signal from a generally periodic, three phase AC signal, each phase of said AC signal having sloping transitions, said apparatus comprising:

a first single integrator circuit connected to receive a first phase of said AC signal for generating an integrated signal from said first phase;

a first reset circuit for resetting said first single integrator circuit at sloping transitions of said first phase;

a second single integrator circuit connected to receive a second phase of said AC signal for generating an integrated signal from said second phase;

a second reset circuit for resetting said second single integrator circuit at sloping transitions of said second phase;

a third single integrator circuit connected to receive a third phase of said AC signal for generating an integrated signal from said third phase;

a third reset circuit for resetting said third single integrator circuit at sloping transitions of said third phase;

means for summing said integrated signals generated by said first, second and third integrator circuits to form said sensing signal.

6. An apparatus as claimed in claim 5 wherein said first, second, and third integrator circuits each comprise:

an op amp having a positive input connected to ground, a negative input, and an output;

a resistor connected between the respective phase of said AC signal and said negative input of said op amp; and a capacitor connected between said negative input of said op amp and said output of said op amp.

7. An apparatus as claimed in claim 6 wherein said first, second, and third reset means each comprise:

a comparator having an input connected to receive the respective phase of said AC signal and further having an output signal indicative of predetermined sloping transitions of the respective phase;

a one shot circuit receiving said output signal of said comparator for generating a reset signal in response to said output signal of said comparator; and a transistor switch connected in parallel with said capacitor of the respective integrator to discharge said capacitor in response to said reset signal.

8. An apparatus as claimed in claim 5 wherein said first, second, and third reset means comprise:

at least on ROM having digital storage bits that are addressable to generate digital signal outputs, said digital signal outputs representing levels of a reference waveform for use in generating said multi-phase AC signal; and means responsive to one or more of said digital signal outputs for generating first, second and third reset signals upon occurrence of a selected pattern of one or more digital signal outputs.

9. An apparatus for generating a sensing signal from a generally periodic, three phase AC signal, each phase of said AC signal having sloping transitions, said apparatus comprising:

a first single integrator circuit connected to receive a first phase of said AC signal for generating an integrated signal from said first phase;

a first reset circuit for resetting said first single integrator circuit at sloping transitions of said first phase;

a second single integrator circuit connected to receive a second phase of said AC signal for generating an integrated signal from said second phase;

a second reset circuit for resetting said second single integrator circuit at sloping transitions of said second phase;

a third single integrator circuit connected to receive a third phase of said AC signal for generating an integrated signal from said third phase;

a third reset circuit for resetting said third single integrator circuit at sloping transitions of said third phase;

means for summing said integrated signals generated by said first, second and third integrator circuits to form said sensing signal; and a common mode rejection circuit connected to said first, second and third phases of said AC signal and to said first, second and third integrator circuits for removing common mode components of said AC signal.

10. An apparatus as claimed in claim 9 wherein said first, second, and third integrator circuits each comprise:

an op amp having a positive input connected to ground, a negative input, and an output;

a resistor connected between the respective phase of said AC signal and said negative input of said op amp;

a capacitor connected between said negative input of said op amp and said output of said op amp.

11. An apparatus as claimed in claim 10 wherein said common mode rejection circuit comprises:

an inverting amplifier having an input connected to receive said first, second, and third phases of said AC signal and further having an output connected to the negative inputs of said op amps of said first, second, and third integrating circuits.

12. A voltage-regulated pulse width modulated inverter system comprising:

inverter means for converting a DC input signal into a three phase AC output signal in response to pulse width modulated switching signal inputs, each phase of said AC output signal having sloping transitions;

PWM generator means for generating said pulse width modulated switching signal input to said inverter means in response to a sensing signal input, said sensing signal input providing control of said pulse width modulated switch signal inputs;

sensing means for generating said sensing signal input from said three AC output signal of said inverter means, said sensing means including, integrating means having a single integrator respectively associated with each phase of said AC signal for generating an integrated signal from the respective phase of said AC signal by integrating said respective phase during a time period between predetermined sloping transitions of said phase, reset means respectively associated with each integrator for resetting each integrator at said predetermined sloping transitions of the respective phase and means for summing said integral signals generated by said integrating means to form a sensing signal.

13. A voltage-regulated pulse width modulated inverter system as claimed in claim 12 wherein said PWM generator means comprises:

an error amplifier having a first input connected to receive said sensing signal output, a second input connected to receive a DC magnitude reference signal, and an output signal;

a sine wave generator having a sine wave output signal;

a scaling circuit for multiplying said sine wave output signal of said sine wave generator by said output signal of said error amplifier, and scaling circuit having an output signal representing multiplication of said sine wave output signal of said sine wave generator by said output signal of said error amplifier;

a triangle wave generator having a triangle wave output signal;

a comparator having a first input connected to receive said output signal of said scaling circuit, a second input connected to receive said triangle wave output signal, and an output connected as said pulse width modulated switching signal input to said inverter means.

14. A voltage regulated pulse width modulated inverter system as claimed in claim 12 wherein said integrating means and said reset means comprise:

a first single integrator circuit connected to receive a first phase of said AC signal for generating an integrated signal from said first phase;

a first reset circuit for resetting said first single integrator circuit at said predetermined sloping transitions of said first phase;

a second single integrator circuit connected to receive a second phase of said AC signal for generating an integrated signal from said second phase;

a second reset circuit for resetting said second single integrator circuit at said predetermined sloping transitions of said second phase;

a third single integrator circuit connected to receive a third phase of said AC signal for generating an integrated signal from said third phase;

a third reset circuit for resetting said third single integrator circuit at said predetermined sloping transitions of said third phase.

15. A voltage-regulated pulse width modulated inverter as claimed in claim 14 and further comprising a common mode rejection circuit connected to said first, second, and third phases of said AC signal to said first, second, and third integrator circuits for removing common mode components of said AC signal.

16. A voltage-regulated pulse width modulated inverter as claimed in claim 13 wherein said sine wave generator comprises:

a ROM containing stored bits representing various levels of said sine wave, said stored bits being addressable to form digital output signals;

means for generating address signals to said ROM to address said stored bits;

a digital-to-analog converter responsive to said digital output signals from said ROM to generate said sine wave output signal.

17. A voltage-regulated pulse width modulated inverter as claimed in claim 16 wherein said scaling circuit comprises said digital to analog converter, said digital to analog converter being connected to receive said output signal of said error amplifier.

18. A voltage-regulated pulse width modulated inverter as claimed in claim 17 wherein said reset means comprises:

a comparator having an input connected to receive the respective phase of said AC signal and further having an output indicative of an occurrence of said sloping transitions; and a one shot circuit for generating a reset signal to the respective integrator in response to said output signal of said comparator.

19. A voltage-regulated pulse width modulated inverter as claimed in claim 17 wherein said reset means comprises:

means responsive to one or more of said digital signal outputs of said ROM for generating said reset signal upon occurrence of a selected pattern of one or more digital signal outputs.

20. A method for generating a sensing signal from a generally periodic multi-phase AC signal, each phase of said AC signal having sloping transitions, said method comprising the steps of:

integrating each phase of said AC signal using a single integrator respectively associated with each phase thereby to generate an integrated signal for each phase;

resetting each integrator at predetermined sloping transitions of its associated phase; and summing said integrated signals generated in said step of integrating to generate said sensing signal.

21. A method for generating a sensing signal from a generally periodic multi-phase AC signal, each phase of said AC signal having sloping transitions, said method comprising the steps of:

integrating each phase of said AC signal using a single integrator respectively associated with each phase thereby to generate an integrated signal for each phase;

resetting each integrator at predetermined sloping transitions of its associated phase;

summing said integrated signals generated in said step of integrating to generate said sensing signal; and removing common mode components of said multi-phase AC signal so that said common mode components do not form a part of said sensing signal.

22. A method as claimed in claim 20 wherein said resetting step is further defined by:

providing at least one ROM having digital storage bits that are addressable to generate digital signal outputs, said digital signal outputs representing levels of a reference waveform for use in generating each phase of said multi-phase AC signal;

addressing said ROM to generate said digital signal outputs;

determining an occurrence of said predetermined sloping transitions of each of said phases by monitoring said digital signal outputs of said ROM;

providing reset signals to said integrators once it is determined that a predetermined sloping transition of the respective phase has occurred.

23. A method for generating a sensing signal from a generally periodic three phase AC signal, each phase of said AC signal having sloping transitions, said method comprising the step of:

integrating a first phase of said AC signal in a time period between said sloping transitions of said first phase for generating an integrated signal from said first phase;

integrating a second phase of said AC signal in a time period between said sloping transitions of said second phase for generating an integrated signal from said second phase;

integrating a third phase of said AC signal in a time period between said sloping transitions of said third phase for generating an integrated signal from said third phase; and summing said integrated signals to generate said sensing signal.

24. A method as claimed in claim 23 and further comprising the step of removing common mode components of said multiphase AC signal so that said common mode components do not form a part of said sensing signal.

* * * * *